US011761180B2

(12) United States Patent
Li et al.

(10) Patent No.: US 11,761,180 B2
(45) Date of Patent: Sep. 19, 2023

(54) STRUCTURE FOR ALIGNING HANDLE AND MOUNTING BASE OF FAUCET AND WIDESPREAD FAUCET INCLUDING SAME

(71) Applicant: XIAMEN DELMEI SANITARY WARE CO., LTD., Xiamen (CN)

(72) Inventors: Wenjun Li, Nanping (CN); Biao Shen, Xiamen (CN); Jianxiong Shen, Putian (CN); Changzheng Ni, Xiamen (CN); Shulong Sun, Sanming (CN)

(73) Assignee: XIAMEN DELMEI SANITARY WARE CO., LTD., Xiamen (CN)

( * ) Notice: Subject to any disclaimer, the term of this patent is extended or adjusted under 35 U.S.C. 154(b) by 127 days.

(21) Appl. No.: 17/407,218

(22) Filed: Aug. 20, 2021

(65) Prior Publication Data

US 2023/0021010 A1 Jan. 19, 2023

(30) Foreign Application Priority Data

Jul. 16, 2021 (CN) ..... 202121630129.2

(51) Int. Cl.
*E03C 1/04* (2006.01)

(52) U.S. Cl.
CPC ..... *E03C 1/0402* (2013.01); *E03C 1/0403* (2013.01); *E03C 1/0412* (2013.01)

(58) Field of Classification Search
CPC ..... E03C 1/0402; E03C 1/0403; E03C 1/0412
See application file for complete search history.

(56) References Cited

U.S. PATENT DOCUMENTS 3,427,049 A * 2/1969 Politz ..... E03C 1/0402 285/193
4,813,444 A * 3/1989 Paul ..... E03C 1/0402 137/315.15
2007/0044232 A1* 3/2007 McNerney ..... E03C 1/0401 4/695
2008/0276367 A1* 11/2008 Bares ..... F16K 19/006 4/677
2013/0019708 A1* 1/2013 Huang ..... E03C 1/0412 74/490.12
2013/0042926 A1* 2/2013 Jonte ..... E03C 1/0402 137/315.12
2014/0197343 A1* 7/2014 Horsman ..... F16K 31/602 251/304
2015/0152975 A1* 6/2015 Jonte ..... F16K 31/602 251/208
2019/0390446 A1* 12/2019 Mooren ..... E03C 1/0401

* cited by examiner

*Primary Examiner* — J C Jacyna

(57) ABSTRACT

The present disclosure provides a structure for aligning handle and mounting base of faucet and a widespread faucet including same. The structure for aligning handle and mounting base of a faucet includes: a water access main body, a cartridge, a mounting base, a handle, a first connecting element, and a second connecting element. A water inlet end of the cartridge is mounted in the water access main body. The mounting base is arranged around the water access main body and is provided with a first mounting hole. The handle is mounted on the cartridge and is provided with a second mounting hole. The first connecting element is inserted in the second mounting hole to fix the handle with a top end of the cartridge. The second connecting element is inserted in the first mounting hole to fix the mounting base with the water access main body.

9 Claims, 10 Drawing Sheets

STRUCTURE FOR ALIGNING HANDLE AND MOUNTING BASE OF FAUCET AND WIDESPREAD FAUCET INCLUDING SAME

CROSS-REFERENCE TO RELATED APPLICATIONS

This application is based upon and claims priority to Chinese Patent Application No. 202121630129.2, filed on Jul. 16, 2021, the entire content of which is incorporated herein by reference.

TECHNICAL FIELD

The present disclosure relates to the field of sanitary ware, in particular to a structure for aligning handle and mounting base of faucet and a widespread faucet including same.

BACKGROUND

Widespread faucets have two handles that are independent of the spout. The two handles are respectively configured to control water inflow and outflow of different water supplying pipes, so as to supply hot water and cold water. Hence, widespread faucets are practical, convenient, and have a wide range of applications.

Nowadays, the handles of the widespread faucets on the market are generally of a quadrangular or polygonal prism shape, which are favored broadly by the consumers due to their innovative design and attractive appearance. However, this type of faucet is time-consuming to assemble because it is difficult to align edges of the handle and edges of the mounting base, or displacement may occur after the alignment.

SUMMARY

The present disclosure provides a structure for aligning handle and mounting base of faucet and a widespread faucet including same, which can effectively solve the above-mentioned problems.

The technical solution of the present disclosure is described below.

A structure for aligning handle and mounting base of a faucet includes:

- a water access main body;
- a cartridge, wherein a water inlet end of the cartridge is mounted in the water access main body;
- a mounting base, wherein the mounting base is arranged around the water access main body and is provided with a first mounting hole;
- a handle, wherein the handle is mounted on the cartridge and is provided with a second mounting hole;
- a first connecting element, wherein the first connecting element is inserted in the second mounting hole to fix the handle with a top end of the cartridge; and
- a second connecting element, wherein the second connecting element is inserted in the first mounting hole to fix the mounting base with the water access main body.

As a further improvement, an inner wall of a top end of the water access main body is provided with a plurality of engaging grooves, an outer wall of the cartridge is provided with a first support rib, and a plurality of engaging protrusions are provided below the first support rib; the engaging protrusions are engaged with the engaging grooves.

As a further improvement, a top end of the cartridge is provided with a cartridge rod, the handle is internally provided with a mounting groove, and the cartridge rod is inserted into the mounting groove.

As a further improvement, an inner wall of the mounting base is provided with a second support rib, a third support rib is provided around the water access main body, and the third support rib supports the second support rib.

As a further improvement, the structure for aligning handle and mounting base of a faucet further includes a screwing element, wherein the screwing element is connected to the top end of the water access main body.

As a further improvement, a top end of the screwing element is provided with a fourth support rib, and the fourth support rib abuts an upper surface of the first support rib.

As a further improvement, the structure for aligning handle and mounting base of a faucet further includes a first screw plug, and the first screw plug is inserted into the first mounting hole.

As a further improvement, the structure for aligning handle and mounting base of a faucet further includes a second screw plug, and the second screw plug is inserted into the second mounting hole.

As a further improvement, the structure for aligning handle and mounting base of a faucet further includes a washer, a top end of the mounting base is provided with a protruding rib, and the washer is arranged around the protruding rib.

The present disclosure in another aspect provides a widespread faucet, which includes the above-mentioned structure for aligning handle and mounting base of the faucet, a spout, and a water pipe connecting the spout and the water access main body.

The present disclosure includes the following advantages.

The structure for aligning handle and mounting base of a faucet includes a water access main body, a cartridge, a mounting base, a handle, a first connecting element, and a second connecting element. The water inlet end of the cartridge is mounted in the water access main body, the mounting base is arranged around the upper end of the water access main body, and the handle is arranged on the top end of the cartridge. In the assembling process, first, the handle is fixed with the top end of the cartridge through the first connecting element; second, the mounting base is rotated to roughly align the edges of the mounting base and the handle; third, the handle kit is put in a mould to accurately align the edges, and the mounting base is fixed with the water access main body through the second connecting element. So far, the alignment of the edges of the handle kit is finished. The structure for aligning handle and mounting base of a faucet of the present disclosure is very simple. The first connecting element and the second connecting element may be screws which facilitates the assembling efficiency. The edges of the handle kit are accurately aligned beforehand, then the handle kit is mounted on the sink. This solution may effectively avoid the difficulties in aligning the edges of the handle and the mounting base in installation.

BRIEF DESCRIPTION OF THE DRAWINGS

In order to clearly explain the embodiments of the present disclosure, the drawings that would be used in describing the embodiments will briefly introduced below. It should be understood that the drawings illustrated below merely includes some of the embodiments of the present disclosure and should not be considered as limiting the scope of the present disclosure. For those of ordinary skill in the art, other drawings may be derived based on these drawings without creative effort.

Figure 1:
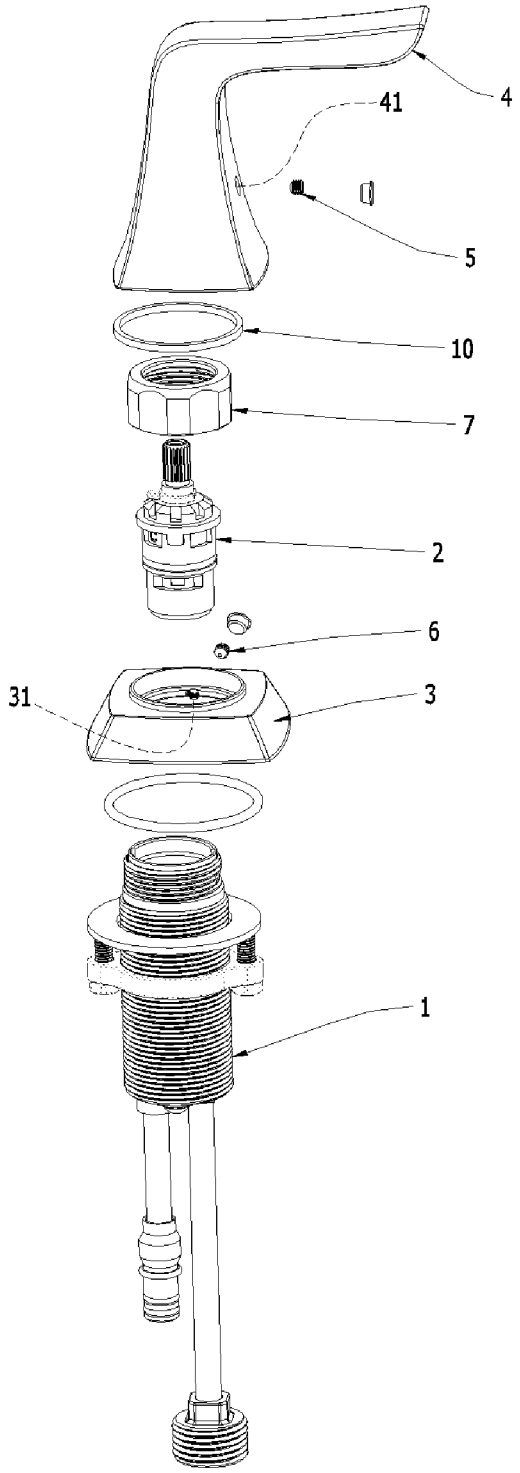
FIG. 1 is an exploded view of a structure for aligning handle and mounting base of faucet according to an embodiment of the present disclosure.

The reference numerals of drawings are listed below:

1. water access main body;
11. engaging groove; 12. third support rib;
2. cartridge;
21. first support rib; 22. engaging protrusion; 23. cartridge rod;
3. mounting base;
31. first mounting hole; 32. second support rib; 33. protruding rib;
4. handle;
41. second mounting hole; 42. mounting groove;
5. first connecting element;
6. second connecting element;
7. screwing element;
71. fourth support rib;
8. first screw plug;
9. second screw plug;
10. washer;
20. mould;
30. spout;
40. water pipe.

DETAILED DESCRIPTION OF THE EMBODIMENTS

In order to make the objectives, technical solutions, and advantages of the embodiments of the present disclosure clearer, the technical solutions of the embodiments of the present disclosure will be described clearly and completely below with reference to the drawings of the embodiments of the present disclosure. Obviously, the described embodiments are parts of, but not all of, the embodiments of the present disclosure. Based on the embodiments of the present disclosure, all other embodiments derived by those of ordinary skills in the art without creative effort fall within the scope of protection of the present disclosure. Accordingly, the following detailed description of the embodiments of the present disclosure shown in the drawings is not intended to limit the scope of protection of the present disclosure, but merely to represent selected embodiments of the present disclosure.

In the description of the present disclosure, the terms "first", "second" are used only for descriptive purposes and cannot be understood as indicating or implying relative importance or implying the number of indicated technical features. Thus, a characteristic that is referred to by "first" and "second" may include, expressly or implicitly, one or more of the characteristics. Also, it should be noted that the terms of "up", "down", "inside/inner", "outside/outer", "front end", "rear end", "two ends", "one end", "another end", "one side", "another side" for indicating the location or orientation are based on the location or orientation shown in the drawings for the sake of simplifying the description of the present disclosure, rather than indicate or imply that the indicated device or component must have specific location or orientation, or be constructed and operated by specific orientation. These terms should not be understood as limits to the present disclosure.

Referring to FIG. 1, an embodiment of the present disclosure provides a structure for aligning a handle and a mounting base of a faucet, which includes: a water access main body 1, a cartridge 2, a mounting base 3, a handle 4, a first connecting element 5, and a second connecting element 6. The water access main body 1 is connected to an external water inlet pipe to flow water through the water access main body 1. The cartridge 2 arranged in the water access main body 1 is configured to switch on or off the water flow. Water flows through the cartridge 2 to enter the water pipe 40 and finally flows out from the spout 30. In the present embodiment, the handle 4 and the mounting base 3 may be of a polygon prism shape, which makes it difficult to accurately align the edges of the handle 4 and the mounting base 3 during assembly. According to the present embodiment, the structure of the handle kit is improved to facilitate the accurate alignment of the edges of the handle and the mounting base during assembling and improve the assembling efficiency.

Specifically, as shown in FIGS. 2-7, according to the present embodiment, a water inlet end of the cartridge 2 is installed inside the water access main body 1. The mounting base 3 is configured around an upper end of the water access main body 1, and the mounting base 3 is provided with a first mounting hole 31. The first mounting hole 31 communicates an outer surface and an inner surface of the mounting base 3. The top end of the cartridge 2 is inserted into the handle 4, and the handle 4 is provided with a second mounting hole 41. The second mounting hole 41 communicates an outer surface and the inside of the handle 4. In the present embodiment, the top end of the cartridge 2 is fixed with the handle 4 by fastening the first connecting element 5 into the second mounting hole 41. The mounting base 3 is fixed with the water access main body 1 by fastening the second connecting element 6 into the first mounting hole 31. Preferably, the first connecting element 5 and the second connecting element 6 are both screws which are fastened through the threads on the inner wall of the second mounting hole 41 and the first mounting hole 31.

Figure 2:
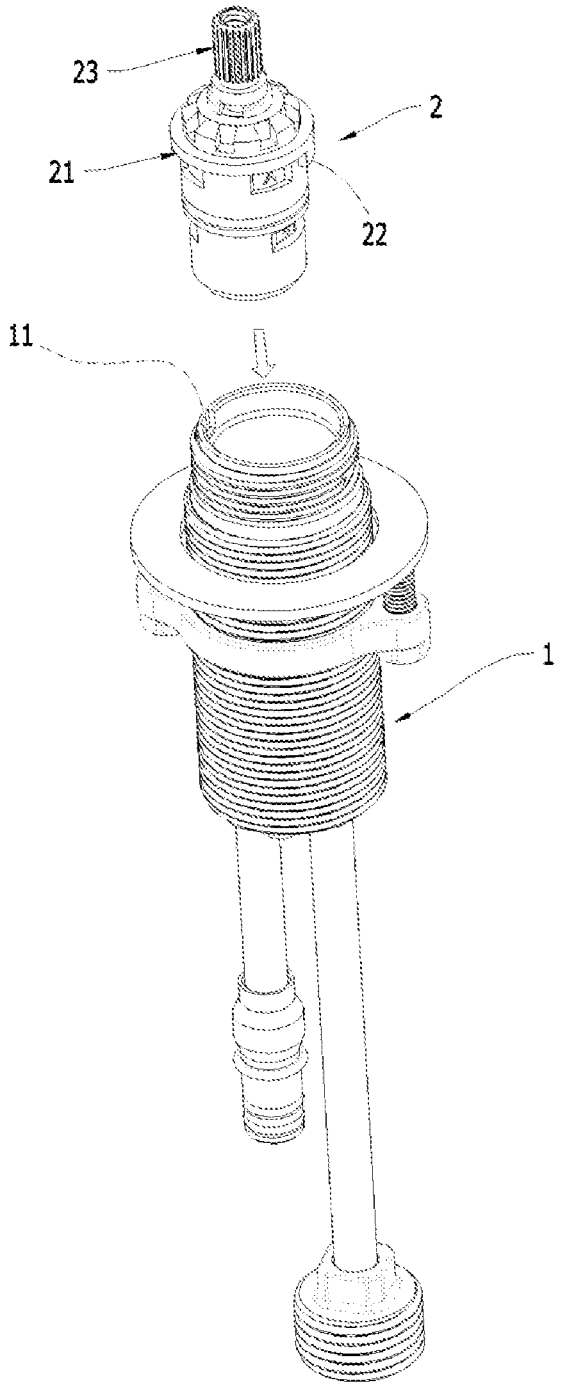
FIG. 2 is a schematic diagram showing an assembling process of a cartridge and a water access main body according to an embodiment of the present disclosure.

Further, as shown in FIG. 2, the inner wall of the top end of the water access main body 1 is provided with a plurality of engaging grooves 11. In the present embodiment, two engaging grooves 11 are provided in symmetrical. The outer wall of the cartridge 2 is provided with a first support rib 21, and a plurality of engaging protrusions 22 are provided below the first support rib 21. In the present embodiment, the engaging protrusions 22 are matched and engaged with the engaging grooves 11.

Figure 5:
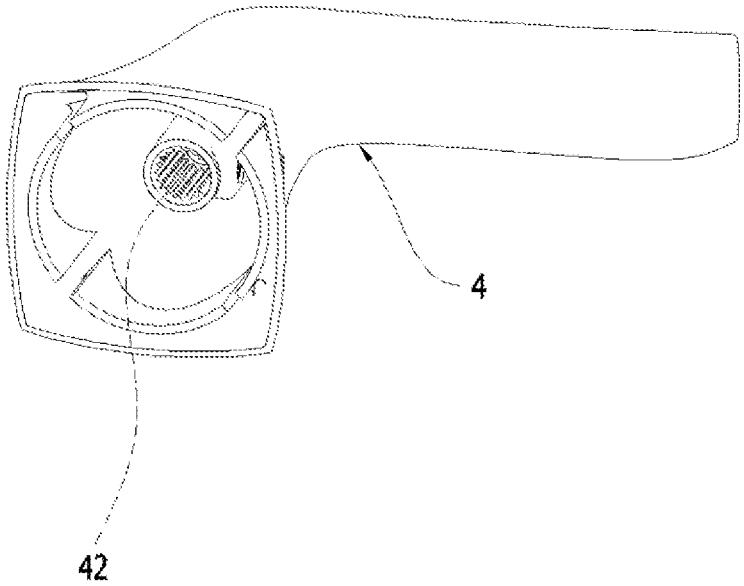
FIG. 5 is a schematic diagram showing an internal structure of the handle according to an embodiment of the present disclosure.

Further, in the present embodiment, the top end of the cartridge 2 is provided with a cartridge rod 23, and the handle 4 is internally provided with a mounting groove 42, as shown in FIG. 5. The outer surface of the cartridge rod 23 is toothed, and the inner surface of the mounting groove 42 is also correspondingly toothed. The cartridge rod 23 is inserted into the mounting groove 42. Since the cartridge rod 23 is fitted with the mounting groove 42, rotating the handle 4 may cause the cartridge rod 23 to rotate, so as to control the cartridge 2.

Figure 3:
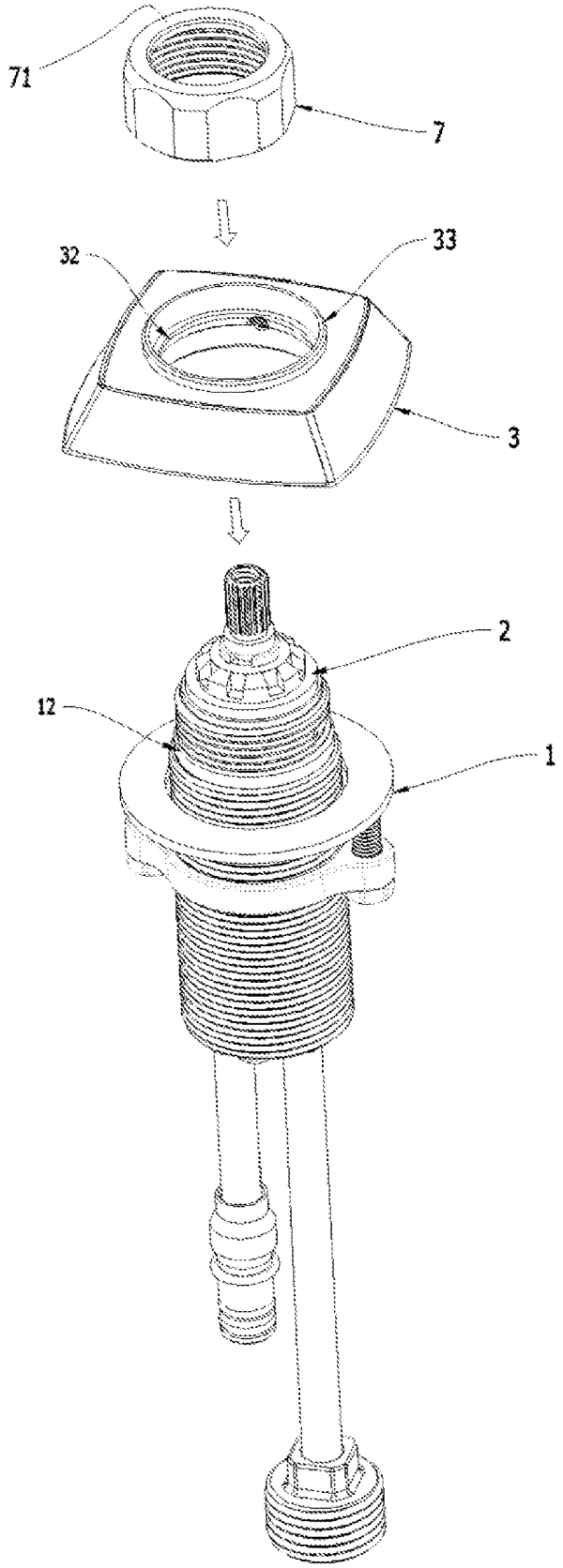
FIG. 3 is a schematic diagram showing an assembling process of a mounting base and a screwing element according to an embodiment of the present disclosure.

Further, as shown in FIG. 3, in the present embodiment, the inner wall of the mounting base 3 is provided with a second support rib 32, and a third support rib 12 is arranged around the water access main body 1. When the mounting base 3 is mounted around the water access main body 1, the third support rib 12 supports the second support rib 32 to fix the mounting base 3 on the water access main body 1.

Further, as shown in FIG. 3, according to the present embodiment, the structure further includes a screwing element 7 connected to the top end of the water access main body 1. The top end of the screwing element 7 is provided with a fourth support rib 71 extending inward, and the fourth support rib 71 abuts an upper surface of the first support rib 21. In the present embodiment, the screwing element 7 is a nut with a threaded inner surface. Accordingly, the outer wall of the water access main body 1 is also threaded, and the screwing element 7 is screwed on the water access main body 1. When the screwing element 7 is fastened, the fourth support rib 71 at the upper end of the screwing element 7 abuts the first support rib 21 on the outer wall of the cartridge 2 to fix the cartridge 2 on the water access main body 1.

Figure 4:
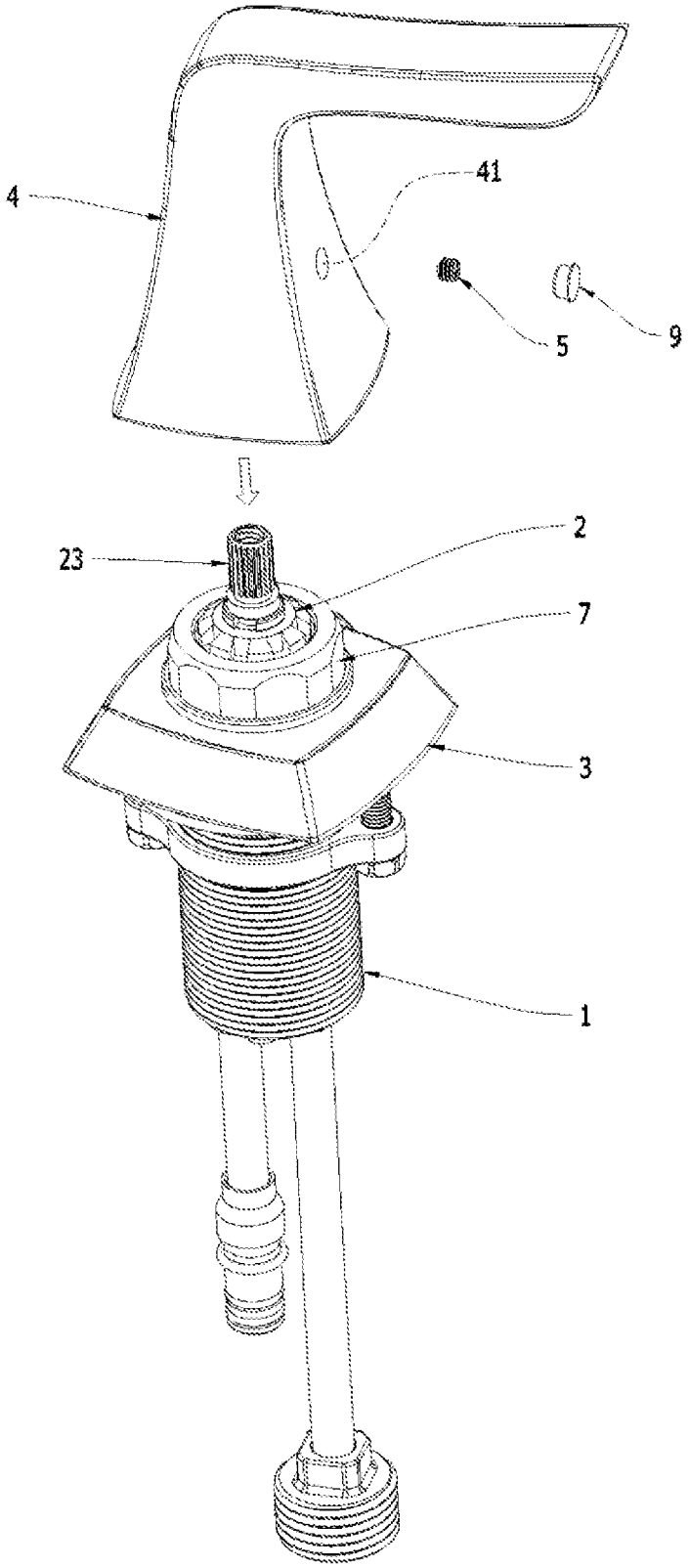
FIG. 4 is a schematic diagram showing an assembling process of a handle according to an embodiment of the present disclosure.
Figure 7:
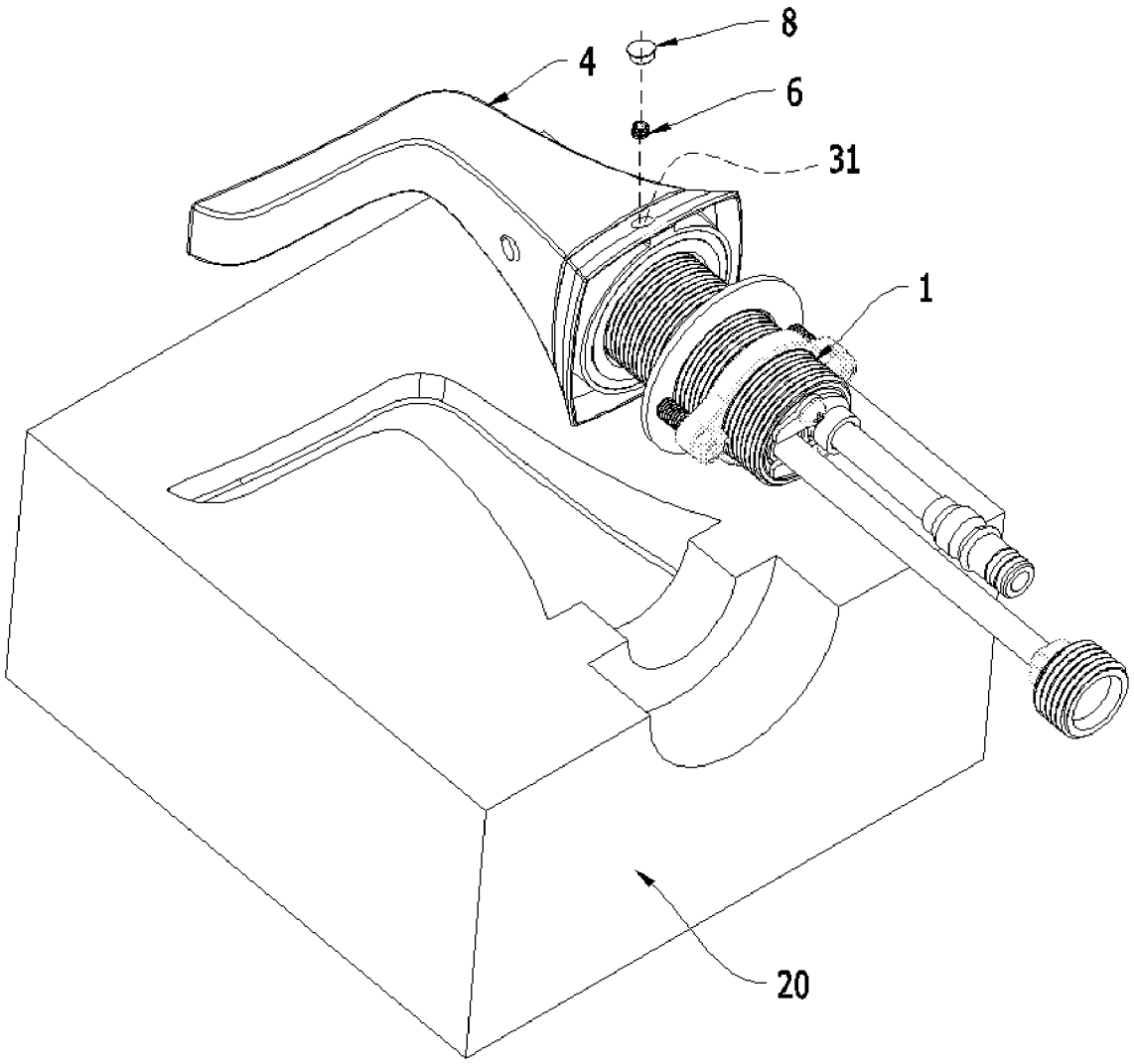
FIG. 7 is a schematic diagram showing a precise alignment of the structure for aligning handle and mounting base of faucet by using a mould according to an embodiment of the present disclosure.

Further, as shown in FIGS. 4 and 7, according to the present embodiment, the structure also includes two screw plugs, namely a first screw plug 8 and a second screw plug 9. The first screw plug 8 is inserted into the first mounting hole 31. After the second connecting element 6 is fastened in the first mounting hole 31, the first screw plug 8 is used to block the first mounting hole 31. The second screw plug 9 is inserted into the second mounting hole 41. After the first connecting element 5 is fastened in the second mounting hole 41, the second screw plug 9 is used to block the second mounting hole 41.

Figure 8:
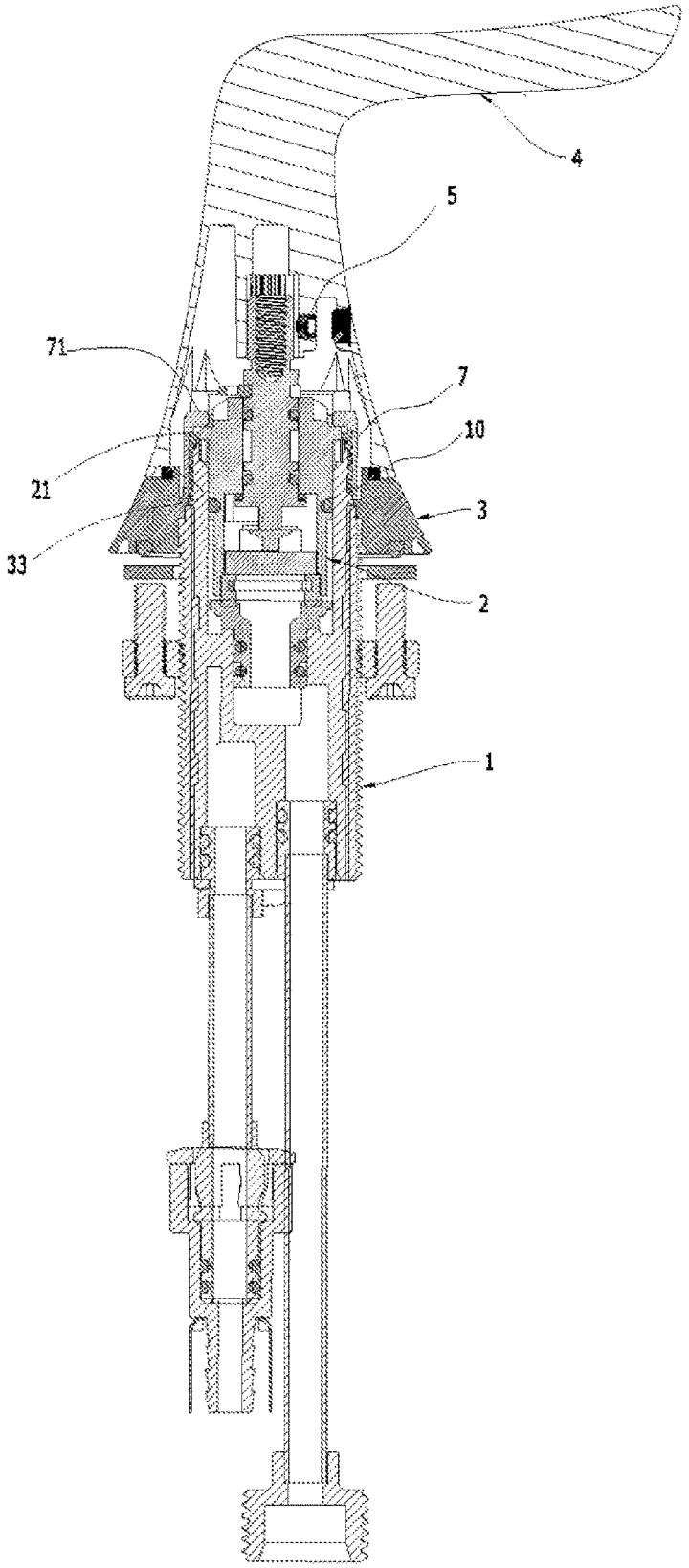
FIG. 8 is a first sectional view of an assembled structure of the handle and the mounting base according to an embodiment of the present disclosure.
Figure 9:
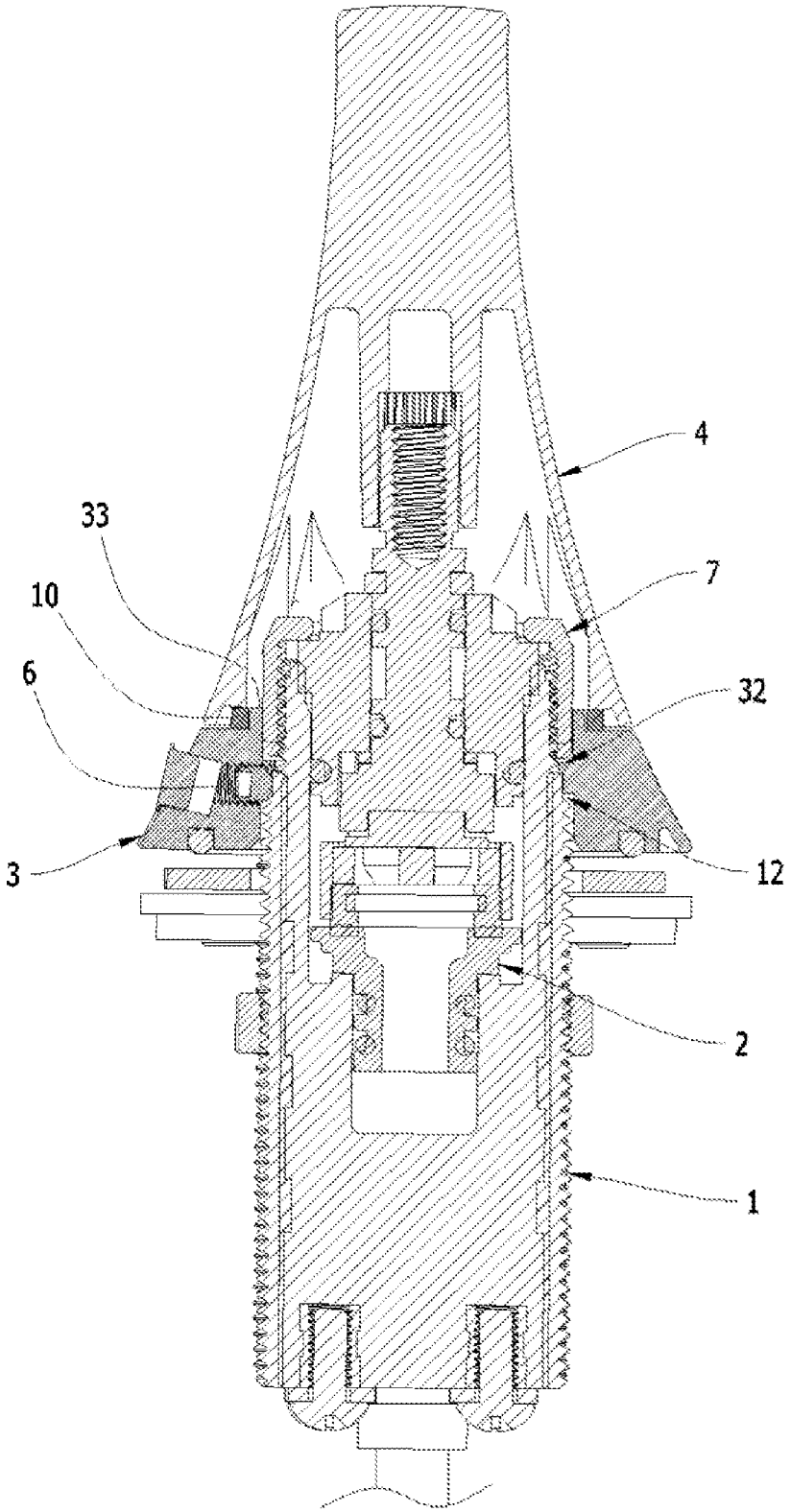
FIG. 9 is a second sectional view of an assembled structure of the handle and the mounting base according to an embodiment of the present disclosure.

Further, as shown in FIG. 8 and FIG. 9, according to the present embodiment, the structure further includes a washer 10. The top end of the mounting base 3 is provided with a protruding rib 33, and the washer 10 is arranged around the protruding rib 33. When the handle 4 is assembled on the top end of the cartridge 2, the relative rotation between the handle 4 and the mounting base 3 will cause friction. The arrangement of the wearproof washer 10 will reduce the effect of friction between the handle 4 and the mounting base 3, so the structure is more durable.

Figure 10:
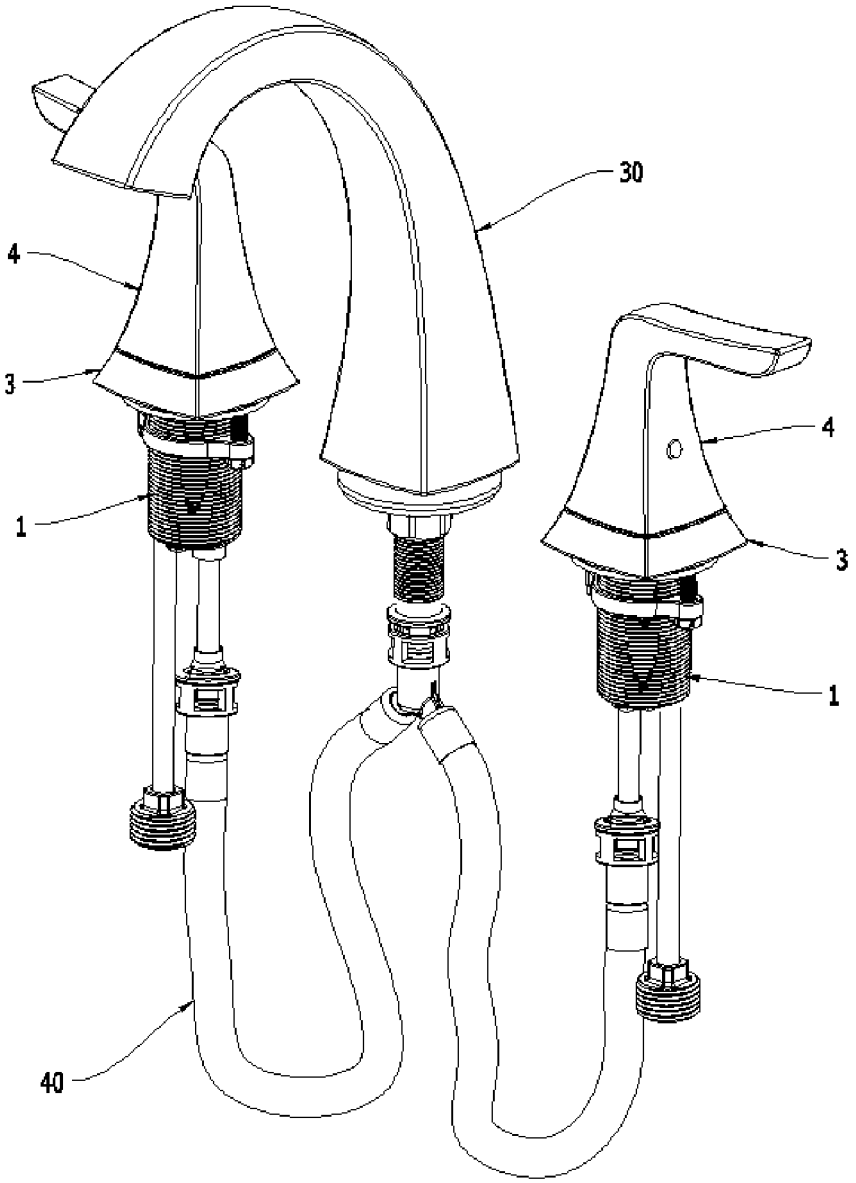
FIG. 10 is a structural schematic diagram of a widespread faucet according to an embodiment of the present disclosure.

Further, as shown in FIG. 10, another aspect of the present disclosure provides a widespread faucet, which includes the above-mentioned structure for aligning the handle and the mounting base, a spout 30, and water pipe 40 connecting the spout 30 and the water access main body 1.

The working principle of the structure for aligning the handle and the mounting base in the present embodiment is described below.

Figure 6:
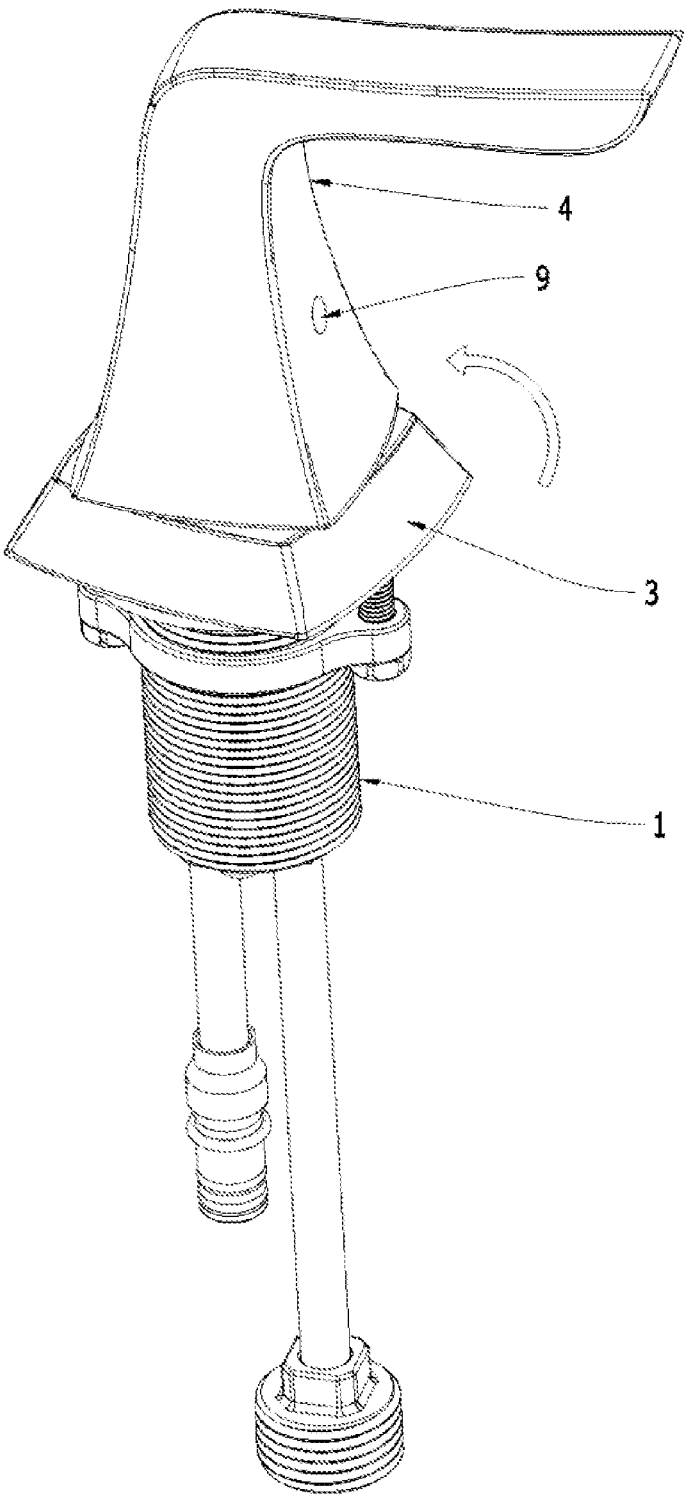
FIG. 6 is a schematic diagram showing a preliminary alignment of edges of the mounting base and edges of the handle according to an embodiment of the present disclosure.

As shown in FIG. 2, the cartridge 2 is installed inside the water access main body 1, the outer sidewall of the upper end of the cartridge 2 is provided with the first support rib 21. The engaging protrusion 22 on the cartridge 2 is engaged with the engaging groove 11 on the inner wall of the upper end of the water access main body 1. Further, as shown in FIG. 3, the mounting base 3 is arranged around the water access main body 1, and the third support rib 12 arranged around the water access main body 1 supports the second support rib 32 on the inner wall of the mounting base 3. Then, the screwing element 7 is fastened on the water access main body 1. The screwing element 7 is screwed until the fourth support rib 71 extending inward on the top of the screwing element 7 abuts the first support rib 21 on the outer wall of the cartridge 2, so as to fix the cartridge 2. Further, as shown in FIGS. 4 and 5, the handle 4 is mounted on the cartridge rod 23, and the cartridge rod 23 is rotated to put the cartridge in a closed state. Then, the handle 4 is fixed with the cartridge rod 23 by the first connecting element 5. Further, as shown in FIG. 6, the mounting base 3 is rotated to preliminarily align the edges of the mounting base 3 and the handle 4. Further, as shown in FIG. 7, the preliminarily aligned handle kit is placed in the mould 20 having a structure fitted with the shape of the handle kit to accurately align the edges of the handle 4 and the mounting base 3. After the precise alignment, the second connecting element 6 is fastened in the first mounting hole 31 to fix the mounting base 3 with the water access main body 1.

The above descriptions merely cover the preferred embodiments of the present disclosure which should not be considered as limit to the present disclosure. For those of ordinary skill in the art, the present disclosure may have various modifications and changes. Any modification, equivalent substitution, improvement made by a skilled person without departing from the spirit and principle of the present disclosure fall within the scope of the present disclosure.

What is claimed is:

1. A structure for aligning a handle and a mounting base of a faucet comprising:

a water access main body;

a cartridge, wherein a water inlet end of the cartridge is mounted in the water access main body;

a mounting base, wherein the mounting base is arranged around the water access main body and is provided with a first mounting hole;

a handle, wherein the handle is mounted on the cartridge and is provided with a second mounting hole;

a first connecting element, wherein the first connecting element is inserted in the second mounting hole to fix the handle with a top end of the cartridge; and a second connecting element, wherein the second connecting element is inserted in the first mounting hole to fix the mounting base with the water access main body; and wherein an inner wall of a top end of the water access main body is provided with a plurality of engaging grooves, an outer wall of the cartridge is provided with a first support rib, a plurality of engaging protrusions are provided below the first support rib, and the engaging protrusions are engaged with the engaging grooves.

2. The structure for aligning the handle and the mounting base of the faucet according to claim 1, wherein a top end of the cartridge is provided with a cartridge rod, the handle is internally provided with a mounting groove, and the cartridge rod is inserted into the mounting groove.

3. The structure for aligning the handle and the mounting base of the faucet according to claim 1, wherein an inner wall of the mounting base is provided with a second support rib, a third support rib is provided around the water access main body, and the third support rib supports the second support rib.

4. The structure for aligning the handle and the mounting base of the faucet according to claim 1, further comprising a screwing element, wherein the screwing element is connected to the top end of the water access main body.

5. The structure for aligning the handle and the mounting base of the faucet according to claim 4, wherein a top end of the screwing element is provided with a fourth support rib, and the fourth support rib abuts an upper surface of the first support rib.

6. The structure for aligning the handle and the mounting base of the faucet according to claim 1, further comprising a first screw plug, wherein the first screw plug is inserted into the first mounting hole.

7. The structure for aligning the handle and the mounting base of the faucet according to claim 1, further comprising a second screw plug, and the second screw plug is inserted into the second mounting hole.

8. The structure for aligning the handle and the mounting base of the faucet according to claim 1, further comprising a washer, wherein a top end of the mounting base is provided with a protruding rib, and the washer is arranged around the protruding rib.

9. A widespread faucet, comprising a handle, a mounting base, a spout, a water pipe, a water access main body, a cartridge, a first connecting element, and a second connecting element;

wherein a water inlet end of the cartridge is mounted in the water access main body, the mounting base is arranged around the water access main body and is provided with a first mounting hole; the handle is mounted on the cartridge and is provided with a second mounting hole; the first connecting element is inserted in the second mounting hole to fix the handle with a top end of the cartridge; the second connecting element is inserted in the first mounting hole to fix the mounting base with the water access main body; the water pipe is configured to connect the spout and the water access main body, wherein an inner wall of a top end of the water access main body is provided with a plurality of engaging grooves, an outer wall of the cartridge is provided with a first support rib, a plurality of engaging protrusions are provided below the first support rib, and the engaging protrusions are engaged with the engaging grooves.

* * * * *